United States Patent [19]

Godlewski

[11] Patent Number: 4,559,873

[45] Date of Patent: Dec. 24, 1985

[54] INKING ROLLER ASSEMBLY

[76] Inventor: Edward S. Godlewski, 129 S. Spruce St., Wooddale, Ill. 60691

[21] Appl. No.: 605,379

[22] Filed: Apr. 30, 1984

Related U.S. Application Data

[63] Continuation-in-part of Ser. No. 385,574, Jun. 7, 1982.

[51] Int. Cl.[4] ..... B41F 31/26

[52] U.S. Cl. ..... 101/329; 101/348

[58] Field of Search ..... 101/328, 329, 330, 331, 101/349, 350, 101, 103, 148, 207, 208, 209, 210, 348; 401/208

[56] References Cited

U.S. PATENT DOCUMENTS

| | | | |
|---|---|---|---|
| 168,115 | 9/1875 | Tuchfarber | 101/349 |
| 449,405 | 3/1891 | Dolphin | 101/367 X |
| 618,253 | 1/1899 | Meyrueis | 101/349 |
| 1,364,257 | 1/1921 | Dobbertin | 101/148 |
| 1,756,308 | 4/1930 | Schmidt | 101/349 |
| 1,955,752 | 4/1934 | Lamatsch | 101/349 |
| 2,162,248 | 6/1939 | Delaplane | 101/148 |
| 2,185,342 | 1/1940 | Keller | 101/350 |
| 2,887,047 | 5/1959 | McKay | 101/349 X |
| 3,336,866 | 8/1967 | Hawthorne | 101/348 |
| 3,457,854 | 7/1969 | Marozzi | 101/330 X |
| 3,559,572 | 2/1971 | Hackley | 101/350 |

FOREIGN PATENT DOCUMENTS

| | | | |
|---|---|---|---|
| 20191 | 5/1929 | United Kingdom | 101/330 |
| 507509 | 6/1939 | United Kingdom | 101/329 |

*Primary Examiner*—J. Reed Fisher

*Attorney, Agent, or Firm*—John J. Kowalik

[57] ABSTRACT

An inking roller assembly wherein the rollers are driven and there being an impositive driving connection between the driven roller and the driving shaft therefor and the roller is driven by impact of the imprinting head and the roller as the roller is struck by the imprinting head, the rollers also being associated with pumping rollers and smoothing rollers for properly distributing the ink and the inking rollers having novel end plates which return the excess ink into the roller. The imprinting head intermittently impacts against limited areas of the inking roller periphery and then moves out of contact with the inking roller to cause the same to thereafter roll freely and thus override the drive imparted thereto by the impositive or one way driving means so that the imprinting head is caused to strike the periphery of the inking roller in different areas randomly.

6 Claims, 6 Drawing Figures

INKING ROLLER ASSEMBLY

This is a continuation-in-part of U.S. Application Ser. No. 385,574, filed June 7, 1982.

BACKGROUND OF THE INVENTION

This invention relates to the printing arts and more particularly to a novel mechanism for expressing the ink from the body of an inking roller to its periphery, and for spreading the ink evenly over its entire periphery for coating a printing head which is impressed thereagainst, so that the head will impress a clear imprint of its indicia on the selected material.

DISCUSSION OF THE PROBLEM

One of the problems with conventional arrangements wherein the printing head strikes the roller, is that after a short period of use, the ink on the roller spreads unevenly and thus does not coat the printing head die properly so that a poor imprint is made on the stock when the die is pressed thereagainst. A further problem has been noted that where the roller and printing head are rotated at different speeds and tangentially engage for ink transfer, the head will strike the roller after a number of revolutions in exactly the same place. This causes premature wear of the roller body and the inking becomes fainter and fainter.

SOLUTION OF THE PROBLEM

In order to continuously coat the periphery of the inking roller with a uniform film of ink, the invention provides a pumping roller which is pressed against the resilient body of the inking roller in a kneading action, thus expressing a constant supply of ink from the roller body to its periphery.

An additional roller may be provided downstream of the pumping roller to spread the ink. Furthermore, in order to prevent repeated contact by the printing head with the inking roller in the same spot, an overrunning clutch arrangement is provided for allowing the inking roller to overrun its drive by having the head impart a slight overrunning torque to the inking roller as the two make contact.

SUMMARY OF THE INVENTION

A primary object of the invention is to provide a novel inking roller assembly which supplies an adequate, even layer of ink to the roller surface.

A further object is to provide in cylindrical inking roller of the type which is saturated with ink, means for confining the ink and prevent the ink from running off from the ends of the roller, said means comprising a pair of end plates which on their sides opposing the respective ends of the rollers are tapered along their peripheries to provide annular troughs for receiving the ink to prevent runoff from the ends of the roller and return the excess ink to the body of the roller through its ends.

These and other objects and advantages inherent in and encompassed by the invention will become more apparent from the specification and drawings, wherein.

DESCRIPTION OF THE INVENTION

Figure 1:
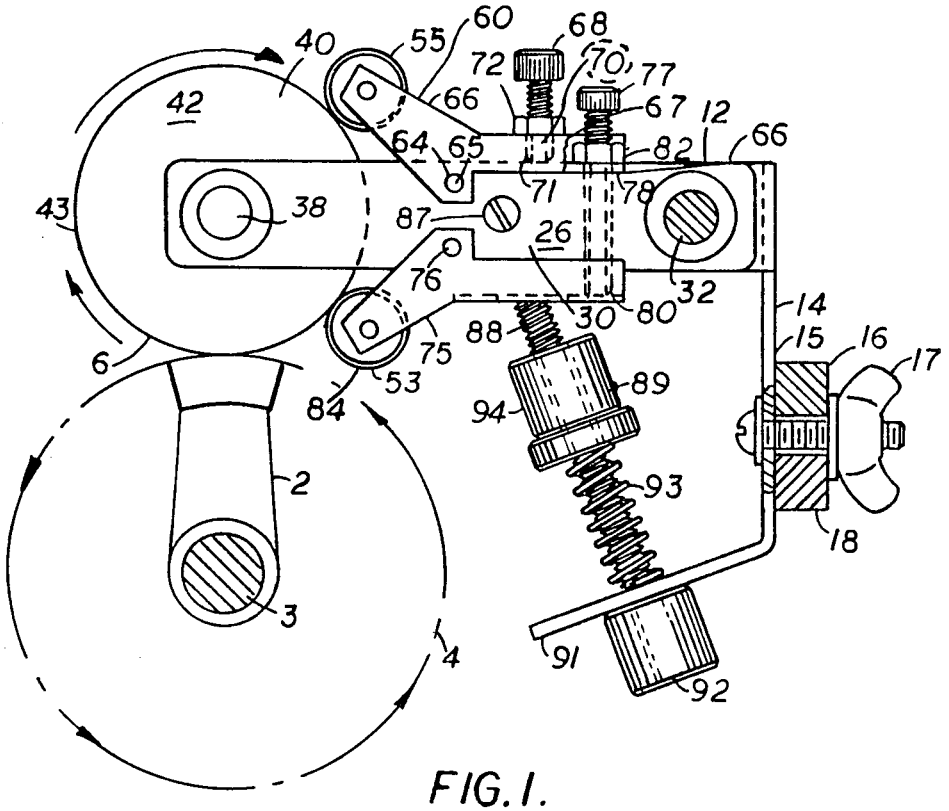
FIG. 1 is a top plan view of an inking roller arrangement and drive therefor with parts omitted for purposes of clarity.

The invention is shown in connection with a numbering machine wherein a numbering printing head 2 is carried and driven by a shaft 3. The head ascribes a circular locus 4 which is tangential to the cylindrical periphery 6 of an inking roller 40.

The roller 40 is made of fiber or elastomer or other well known resilient material and is impregnated with ink. Each roller 40 has a carrier assembly 12 associated therewith. The carrier assembly 12 comprises a mounting bracket 14, including a vertical standard 15 which is secured intermediate its ends to a support bar 16 by a bolt and wing nut 17 to a horizontal support bar 16, which at its ends is suitably connected to the side frames 20,22 of the machine.

The upper end of the bracket 14 may be U-shaped in plan, having a cross-member 23 integral with the upper end of standard 15 and a pair of parallel legs 24,25 which extend from the ends of the member 23. The legs 24,25 are flanked by the legs 26,28 of an H-shaped yoke 30 and a horizontal connecting shaft 32 extends through aligned bushed openings 34,35,36,37 in these legs, allowing the yoke 30 to pivot vertically about the shaft 32. The distal ends of the legs 26,28 are provided with bushed apertures through which there is journalled a countershaft 38 which extends through the axis of a cylindrical ink-impregnated inking roller 40.

The roller 40 is clamped between a pair of end disks 42,42 made of metal or plastic, and the disks are tapered outwardly at their peripheral edges to form frusto-conical margin surfaces 44,44, and provide trough-like grooves 45,45 with the opposing flat ends 46,46 of the roller so that any excess ink expressed to the surface 43 will flow into the troughs and be reabsorbed into the material of the roller body. Preferably the counter-shaft extends through a center bore 47 in the roller body and has a friction fit with the roller. The counter shaft rides in bearings 48,48 and is connected to a pulley 49 at one end about which there is trained a belt 50 which is driven from a pulley 51 connected to drive shaft 32.

Figure 5:
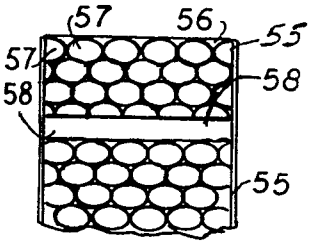
FIG. 5 is a side elevation of a pumping roller.

As best seen in FIG. 1, the head 2 and roller rotate in opposite directions except in area of contact with the peripheral speed of the head being slightly greater than that of the surface 43 of the roller, such that upon the head engaging surface 43 it drives the roller slightly faster than the drive through the counter shaft, so that the roller slightly overruns it. The roller 40 is engaged by a plastic or metal ink spreading or smoothing roller 53 and upstream therefrom is engaged by a pumping roller 55. The pumping roller 55 as best seen in FIG. 5 is perferably a metallic or plastic cylinder having a reticulated surface 56, preferably formed by a plurality of closely spaced depressions 57,57 arranged in axial rows with intervening axially elongated bars 58 extending the length of the pumping roller 55. The roller 55 is pressed against the periphery of the inking roller and functions with a kneading action to express the ink to the peripheral surface 43 of the inking roller.

Roller 55 is mounted on bracket 60 between legs 62,63 thereof, which are pivotally connected as at 64 by a pin 65 on a horizontal axis to the legs 26, 28 of yoke 30.

Legs 62,63 are connected by a spanning wall 66 which overlaps the cross-member 67 which connects the legs 26,28 of the yoke 30. In order to adjust the pressure at which the pumping roller 55 is pressed against the inking roller 40, an adjuster screw 68 is provided which is threaded through a threaded opening 70. The lower end 71 reacts against the top side of wall 66 when the end 71 is advanced toward wall 67, causing the bracket 60 to pivot counterclockwise (FIG. 1) against the periphery of the inking roller. A locking nut 72 may be threaded onto the shank of screw 68 and tightened against the top of wall 66 to hold the screw 68 in adjusted position.

Similarly, the smoothing roller 53 may be mounted on a horizontal axis to a bracket 75 pivoted on pin 76, carried by legs 26,28 and bracket 75, which is identical with bracket 60 except mounted upside down may be swung about a horizontal axis of pin 76 toward and away from the inking roller. A bolt 77 has its shank extending through a threaded opening 78 in wall 67 of yoke 30 and is entered at its lower end into a socket 80 formed in the wall 66. A locking nut 82 is threaded on the shank of bolt 77 and seats on top of wall 67. The bolt 82 is retracted with respect to bracket 75 to swing the bracket 75 in a counterclockwise direction (see FIG. 1) to thus decrease the pressure of the smoothing roller with respect to the inking roller. In order to increase the pressure of the smoothing roller against the inking roller, the bolt 82 is advanced toward bracket 75, causing it to swing in a clockwise direction and urging the smoothing roller against the inking roller.

The smoothing roller 53 may have a smooth peripheral surface 84 as shown in FIG. 1, or it may have sinistrorsal threads 85 and dextrorsal threads 86 on fins formed from the center toward the ends of roller 53. The function of these threads is to spread the ink across the entire axial extent of the inking roller to insure proper coverage.

It will be seen from FIG. 1 that the legs 26,28 of the yoke 40 are connected by a pin 87 to which there is pivoted the upper end of the shank 88 of an adjusting bolt 89, which has its lower portion 90 threaded and which extends through an opening in an inwardly bent end portion 91 of the standard 15 of bracket 14. A head 92 is provided on the lower end of portion 90 and bears against the underside of portion 91 to compress spring 93 sleeved on portion 90. Spring 93 is seated at its lower end on top of bracket portion 91 and its upper end against a nut 94 which is threaded on the upper end of the lower portion 90 of the adjusting bolt shank. Adjustment of nut 94 determines the pressure of the inking roller with respect to the printing head.

DESCRIPTION OF FIGS. 3 AND 4

Figure 2:
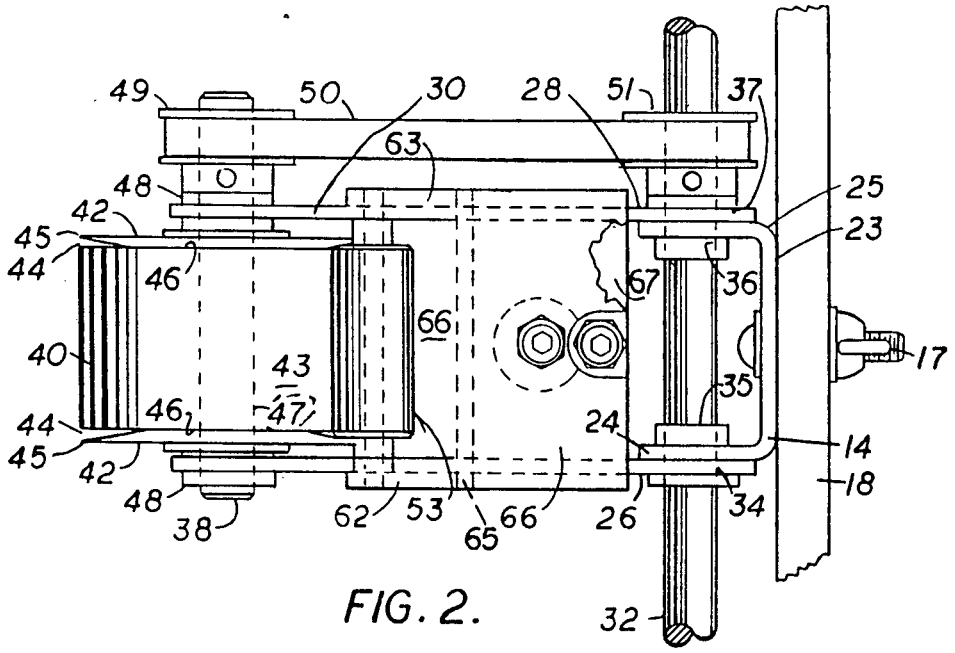
FIG. 2 is a fragmentory transverse sectional view of one embodiment of the invention taken substantially on line 2—2 of FIG. 1.
Figure 3:
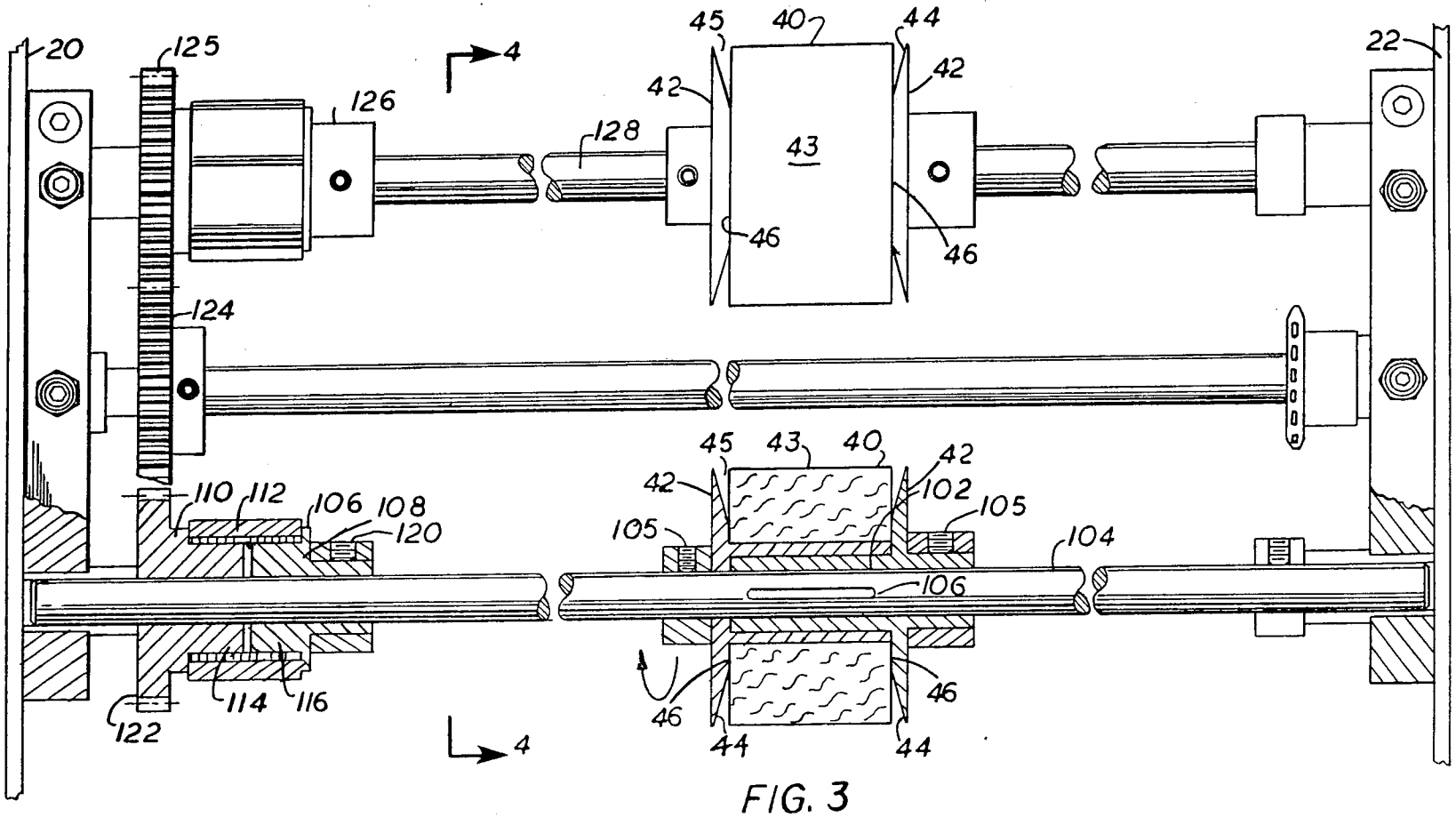
FIG. 3 is a top plan view of another embodiment of the invention.
Figure 4:
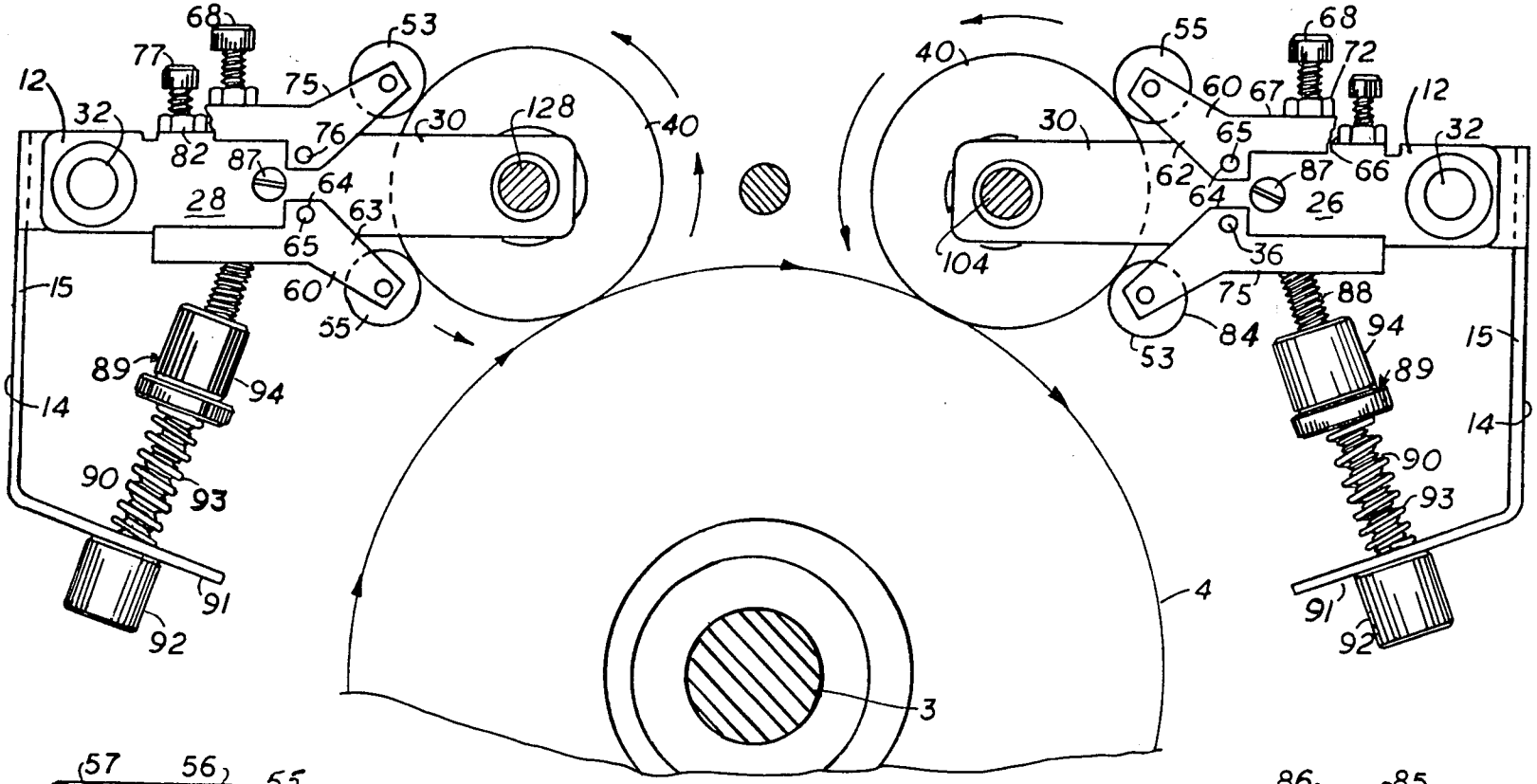
FIG. 4 is a vertical sectional view taken substantially on line 4—4 of FIG. 3 with parts omitted for clarity.
Figure 6:
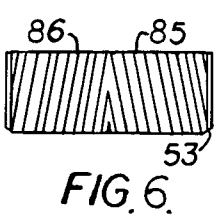
FIG. 6 is a side elevation of a spreading roller.

The structure shown in FIGS. 3 and 4 is essentially functionally the same as that of FIGS. 1 and 2 and like parts will be identified with the same reference numerals.

In this embodiment two inking rollers 40,40 are used and the head 2 is mounted on a driving shaft 3 to move in a locus tangential to both rollers 40,40. The rollers rotate on horizontal axis and each comprises a metal or plastic core 102 which is sleeved over a drive shaft 104 and keyed thereto as by a key 106 and secured to its driving shaft 104 by screws 105 as well known for maintaining the respective inking roller in a selected position longitudinally of the shaft 104.

Each shaft 104 is coupled to a one-way clutch 106 which includes driven and driving elements 108,110 sleeved on the respective shaft 104 and a coil spring 112 wrapped about the cylindrical drums 114,116.

Element 108 is constrained to rotate with shaft 104 by tightening a locking screw 120 threaded into the respective element 108.

Element 108 may be part of a spur gear 122 which meshes with gear 124, which in turn meshes with gear 125, which also drives a one-way clutch 126 connected to shaft 128, to which is mounted the second inking roller 40.

It will be seen in FIG. 4 both rollers rotate in the same direction and each is associated with a pumping roller and smoothing roller, except that the pumping and smoothing rollers are reversed, so that in each instance the associated inking roller is dressed with a smooth film of ink.

Several preferred embodiments of the invention have been shown which disclose the best modes, but are not intended to limit the scope of the invention which is set forth in the appended claims.

It will be understood that the printing head is formed and arranged to have periodic impinging limited spot contact with the periphery of the inking roller, and that as the inking roller is struck it overruns its drive and after the printing head separates from the inking roller the inertia will thereafter cause the inking roller to roll freely to index different peripheral areas of the roller to successive spot impacts by the printing head.

I claim:

1. For use with a driven printing device having a printing face, a rotatable roller assembly comprising an inking roller having a body with an ink-releasing periphery adapted for association with said printing device which is mounted to move in wiping contact with said periphery of the inking roller to pick up ink on the printing face thereof, means connected to said body for rotationally driving said inking roller and including an impositive driving connection therethrough accommodating rotation of said inking roller overrunning its said driving means by said device wiping against said inking roller, a free rolling pumping roller pressed against the periphery of the inking roller and driven thereby, and said inking roller having a pair of end members seated against opposite ends thereof, said end members having peripheral edge portions spaced from the respective ends of the inking roller and defining therewith ink-receiving troughs recessed below the periphery of the inking roller to return to the ends of the inking roller ink expressed from the periphery of the inking roller by said pumping roller.

2. The combination of a rotatable printing head having a limited peripheral printing face, a rotatable inking roller including a body having an ink-releasing periphery, said printing head formed and arranged to have periodic tangential impinging contact at its face with the periphery of the said inking roller, means for driving said inking roller at a peripheral speed slightly slower than that of said printing head, means for accommodating rotation of said inking roller to overrun for accommodating rotation of said inking roller to overrun the drive thereto and to rotate at substantially the peripheral speed of said head upon being contacted thereby and to thus inhibit scuffing of the periphery of the inking roller and to thereafter separate from said head and rotate freely to randomly index different peripheral areas of the roller to successive spot impacts by said printing head.

3. The invention according to claim 2 and at least one pressure roller mounted in pressing contact with the periphery of the inking roller and driven thereby.

4. The invention according to claim 2 and said means for driving said inking roller comprising a one-way clutch.

5. The invention according to claim 3 and an ink-spreading roller mounted in peripheral engagement with the periphery of the inking roller in driven relation thereby.

6. An inking roller having an ink-impregnated roller body of material, means providing a central axis of rotation for said body, and means at the opposite ends of said body for returning to the radial ends of the body ink expressed from said body to its periphery by associated means to prevent the ink from running off the ends of said body, said ink returning means comprising a pair of disks disposed one at each end of the body, and each disk and adjacent end of the body having means defining a trough recessed radially inwardly from said periphery toward the axis of the body for accumulating ink below the periphery of the body and entering such excess ink into the body through its radial ends. and said disk having frusto-conical inner contours facing the respective opposing ends of the roller and said contours having apices disposed inwardly of the periphery of the roller and facing respective ends of the body.

* * * * *